United States Patent [19]

Schultz

[11] 4,054,346

[45] Oct. 18, 1977

[54] CATHODE RAY TUBE SOCKET WITH INCREASED TUBE BASE RETENTION

[75] Inventor: Ronald L. Schultz, Northfield, Ill.

[73] Assignee: Chromalloy-Alcon, Inc., Chicago, Ill.

[21] Appl. No.: 672,539

[22] Filed: Apr. 1, 1976

[51] Int. Cl.[2] ..... H01J 5/60; H01R 13/76

[52] U.S. Cl. ..... 339/75 T; 313/318; 339/145 T; 339/184 T

[58] Field of Search ..... 339/64 M, 66 T, 75 T, 339/91 C, 143 T, 144 T, 145 T, 184 L, 184 T, 185 T, 192 T, 193 S, 210 T, 216 T, 252 T, 256 T, 273 F, 313–318

[56] References Cited

U.S. PATENT DOCUMENTS

| | | | |
|---|---|---|---|
| 3,200,363 | 8/1965 | Morgan | 339/75 T X |
| 3,771,105 | 11/1973 | Yamazaki et al. | 339/66 T X |

*Primary Examiner*—Roy Lake
*Assistant Examiner*—E. F. Desmond
*Attorney, Agent, or Firm*—Hill, Gross, Simpson, Van Santen, Steadman, Chiara & Simpson

[57] ABSTRACT

A socket body has increased retention means for push-on retaining engagement with a tube base supplemental to the usual frictional retaining engagement between mating terminals of the socket and tube base. In one form the increased retention means comprises a compressible split key. In another form the increased retention means comprises gripping fingers.

20 Claims, 10 Drawing Figures

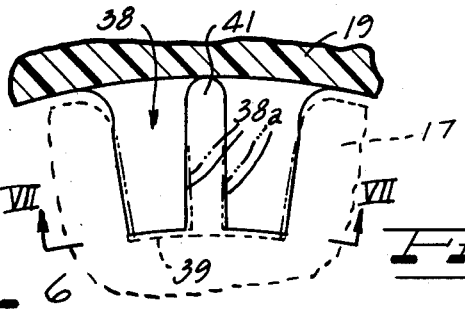
Fig. 6
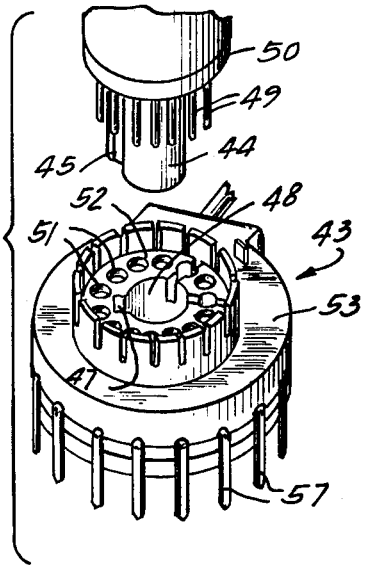
Fig. 8
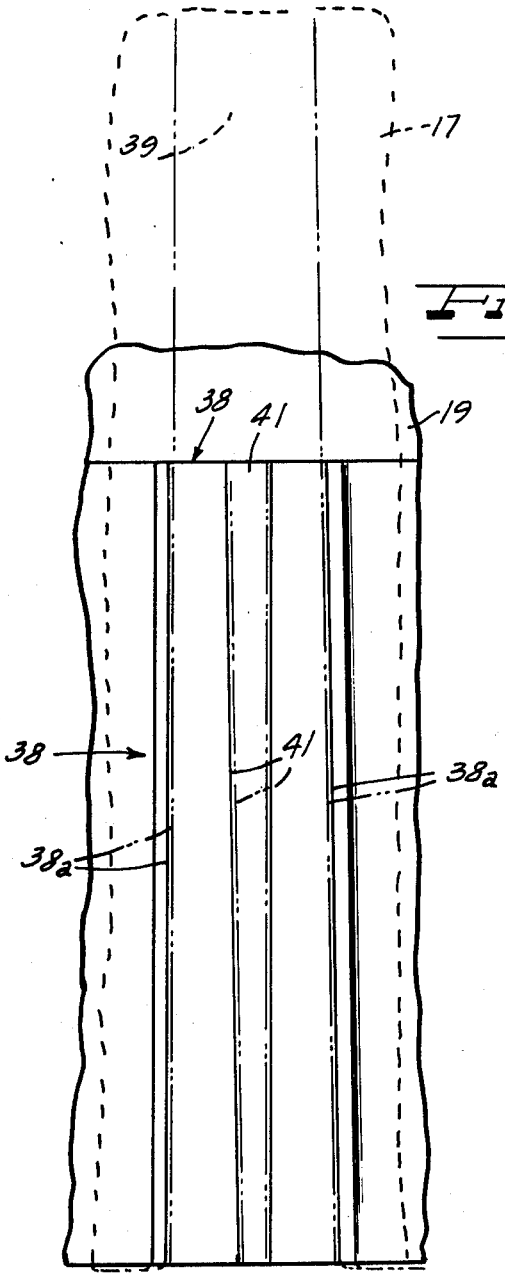
Fig. 7
Fig. 9
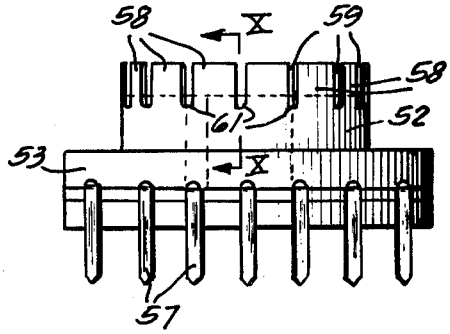
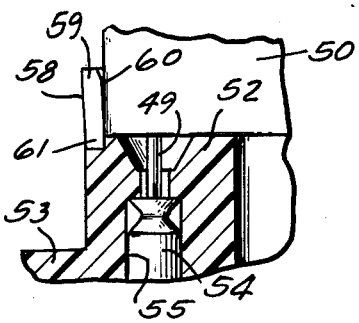
Fig. 10

CATHODE RAY TUBE SOCKET WITH INCREASED TUBE BASE RETENTION

This invention relates to improvements in tube sockets and more particularly to sockets for push-on assembly with the base ends of cathode ray tubes.

Cathode ray tubes have at their base ends an array of pin terminals which engage frictionally with complementary terminals carried by tube sockets and through which electrical connection is effected with the circuitry of a television receiver. Heretofore, frictional engagement between the tube and socket terminals has been relied upon to retain the tube base in assembly with the socket. Although the sockets themselves are not especially heavy, when there is added to the assembly appropriate circuitry carried on a printed circuit board, with the socket mounted on the board and the terminals connected to the printed circuitry, problems have been encountered in maintaining adequate retention to avoid looseness or even falling away of the socket from the tube base under conditions of vibration and handling such as encountered in shipping and installation or even in service. In an attempt to overcome this problem, tolerances in contact dimensions have tightened up, but this has injected a further problem in that excessive spring pressure causes the initial push-on assembly force to be increased to such an extent that there is a tendency toward overstress and even canting distortion of electrical terminals. Further, high additional insertion forces tend to promote printed circuit foil breakage by bending of the board due to the strenuous manipulative effort required to effect the assembly. In addition, lack of lateral stability between the socket and tube bas has been a problem.

An important object of the present invention is to provide new and improved electrical tube socket structure, especially of the cathode ray tube type, which overcomes the disadvantages, deficiencies, inefficiencies, shortcomings, and problems encountered with prior sockets of this and which will assure adequate, positive retention of the tube sockets and tubes in assembly.

Another object of the invention is to provide new and improved increased retention means for sockets of the cathode ray tube type.

A further object of the invention is to provide new and improved increased retention means on the body structure of cathode ray tube sockets.

Still another object of the invention is to provide increased retention means on cathode ray tube sockets which will receive standard cathode ray tube base structure.

According to features of the invention there is provided an electrical socket especially adapted for assembly with the base of a cathode ray tube and comprising a dielectric body carrying an array of terminals for frictional push-on retaining engagement with complementary terminals on a cathode ray tube base, and increased retention means for push-on retaining engagement between the tube base and the socket supplemental to any retention cooperation between the base and socket terminals. In one form, the increased retention means may comprise compressible key structure. In another form the increased retention means may comprise gripping fingers.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 6 is a greatly enlarged fragmentary sectional top plan detail view taken substantially along the line VI—VI of FIG. 2.

FIG. 7 is a fragmentary illustrative elevational view taken substantially in the plane of line VII—VII of FIG. 6.

FIG. 8 is an exploded assembly view showing a modified cathode ray tube base and socket embodying features of the invention.

FIG. 9 is a side elevational view of the socket in FIG. 8, and

FIG. 10 is an enlarged fragmentary sectional detail view taken substantially along the line X—X of FIG. 9.

Figure 1:
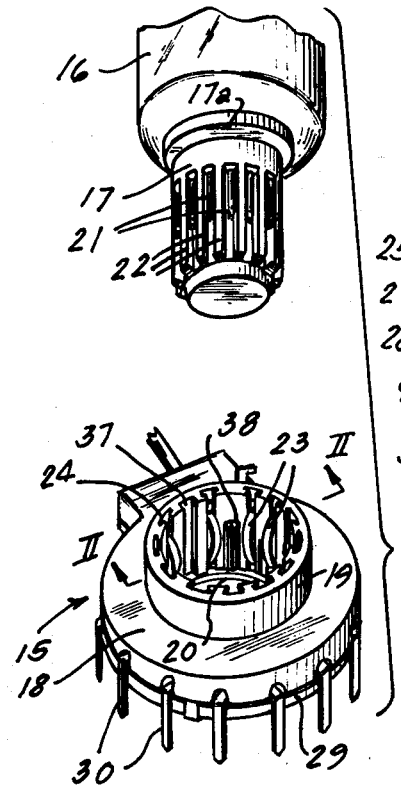
FIG. 1 is an exploded view showing a cathode ray tube base and a socket embodying features of the invention.
Figure 2:
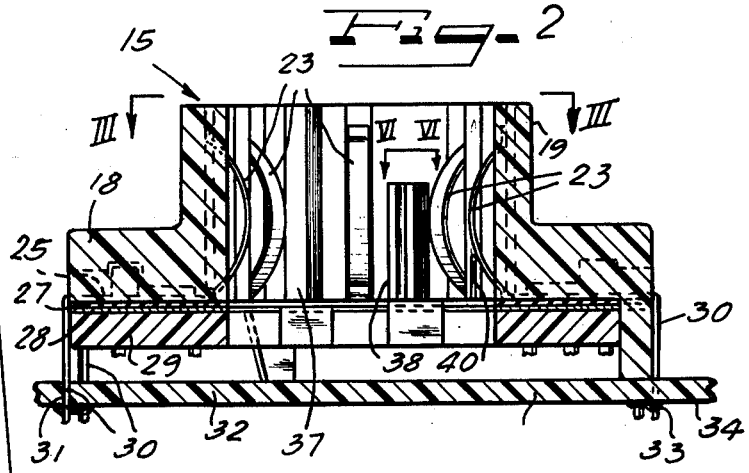
FIG. 2 is an enlarged vertical sectional detail view taken substantially along the line II—II of FIG. 1 and showing the socket mounted on a printed circuit board.

In FIG. 1, a cathode ray tube socket 15 is shown which is adapted for assembly with a cathode ray tube 16 and more particularly is receptive of a stem-like base 17 of the cathode ray tube. The socket 15 is of the type having a body 18 molded from a suitable dielectric material such as a glass filled polyester resin and of generally disk form having a front or top face from which projects a smaller diameter tube mount platform boss 19. Centrally through the body 18, including the boss 19 is a socket aperture 20 complementary to and receptive of the stem-like base 17 which is adapted to extend into and through the socket aperture until a stop collar 17a on the proximal end of the base seats against the crown of the boss 19. Terminal pins 21 carried by the base 17 rest in longitudinal grooves 22 in the perimeter of the base and which run out at its distal end whereby to receive inwardly bowed resilient wiper terminals 23 seated in complementary longitudinal grooves 24 formed in the wall defining the central aperture in the socket body 18 and the boss 19. The wiper terminals 23 project sufficiently from the grooves 24 to make firm electrical contact with the tube terminals 21 as best visualized in FIG. 3. Tail pieces 25 (FIG. 2) on the inner ends of the contacts 23 extend radially outwardly between the body 18 and a thin annular perforated insulating gasket 27 over a grounding ring 28, all sandwiched between the back of the body 18 and a cover plate 29. Tail terminals 30 extend from the outer ends of the tail pieces 25 generally axially away from the back of the socket and are adapted to extend through suitable slots 31 in a printed circuit board 32 for connection as by means of soldering 33 to printed circuit foil 34 carried by the board.

Proper orientation of the tube terminals 21 with the respective socket terminals 23 is effected by means of dual orientation key means on the base 17 and the socket body 18, comprising a key 35 (FIG. 3) on the base received in a longitudinal keyway grooves 37 in the wall defining the central socket aperture 20, and a key 38 molded integral with the body 18 and received in a complementary longitudinal keyway groove 39 in the perimeter of the tube base 17. In the final increment of push-on relative axial assembly of the base 17 with the socket 15, short, line contact, centering ribs 40 provided at equally spaced points at the lower end of the aperture bore 20 in the socket body 18 engage the distal end portion of the base 17 in centering, stabilizing relation.

Figure 3:
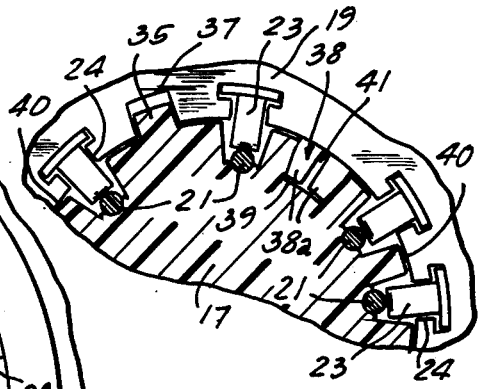
FIG. 3 is a fragmentary horizontal sectional detail view taken substantially along the line III—III of FIG. 2 and with the tube base shown in assembled relation with the socket.

Although frictional engagement between the substantial number of tube base terminals 21 and the corresponding socket wiper terminals 23 provides for substantial retention of the base and the socket in assembly, such retention is not fully satisfactory as pointed out earlier herein, especially where the appropriate circuitry is contained on the printed circuit board 32 which has the socket 15 mounted thereon and such assembly then carried by the tube base 17. Conditions of vibration and handling such as in shipping and installation or in service may loosen and tend to shake the socket 15 from the tube 16. According to the present invention such loosening is prevented by new and improved increased retention means comprising in one desirable form a stiffly resiliently, tensionably compressible split construction of one of the tube base and socket orienting keys, for example the socket carried key 38. For this purpose, the key 38 is located in the inner end portion of the base stem receiving bore 20 of the socket 15 and limited in length so that it engages in the keyway 39 only after the tube socket 17 has been received to a substantial extent into the socket bore. Resilient compressibility of the key 38 is attained by providing it with a longitudinal median slot 41 extending throughout its length and throughout its depth. Thereby the key rib is divided into equal relatively stiffly resiliently flexible separated half portions 38*a*. By having the overall dimension between the opposite sides of the rib 38 slightly oversize relative to the sides of the lower end portion of the keyway groove 39, a releasable substantially press fit frictional retaining engagement is effected in the final increment of relative press-on assembly of the tube base and socket. As is normal practice, the keyway groove 29 has a slight draft angle of on the order of one-half degree from the distal end toward the proximal end of the base 17. Therefor, in the initial registration of the key 38 and the keyway groove 39, relatively free axial movement is permitted between the walls of the groove and the sides of the key. As the assembly reaches the bottoming out relationship, that is, the fully assembled relationship, the outer sides surfaces of the key portions 38*a* and the side wall surfaces defining the keyway groove 39 interengage in firm press fit with squeezing pressure on the key structure, that is, tensioning the portions 38a toward one another and thereby compressing the key 38, with the maximum compression and thus frictional retaining interengagement between the engaged gripping surfaces of the key and keyway being attained in the final increment of the relative push-on assembly movement of the tube and socket. The final interengaged relationship is shown in FIG. 3.

By way of graphic illustration of the increased retention compression interengagement of the key 38 with the walls of the groove 39, FIGS. 6 and 7 are referred to. Each of the key portions 38*a* desirably has its outer side surface tapered toward the inner edge of the key at about a 12° angle to the radius of the generally cylindrical platform boss 19 and formed with a longitudinal draft of about ½° converging toward the top or distal end of the boss 19. These angles in the outside faces of the key portions 38*a* generally complement the side wall surfaces within the keyway groove 39. By having the uncompressed width between the outer side surfaces of the key portions or segments 38*a* slightly greater than the width of the keyway groove 39, as demonstrated on comparison of the full line illustration of the key 38 in FIGS. 6 and 7 with the dash outline illustrating the sides of the groove 39 in FIGS. 6 and 7, it will be observed that in the final increment of relative push-on assembly of the socket and tube, the key segments 38a are resiliently deflected toward one another, that is compressed to the dot dash outline condition shown, which is substantially equivalent to the dimensional differential between the sides of the key 38 and the sides of the groove 39. Where the key 38 is about 0.338 inch in length and about 0.085 inch in width across its inner edge, a differential of about 0.001 to 0.003 inch has been found to provide satisfactory results. It may be observed that a differential spacing is perferably provided for between the inner edge of the key 38 and the bottom of the keyway groove 39. As a result of this construction and relationship of the key 38 to the keyway groove 39, a substantially longer push-on assembly stroke is attained free from harsh or peak resistance until the final increment of the relative assembly stroke. In other words, there is a smooth limited frictional resistance to the relative push-on assembly stroke after the tube base terminals 21 and the socket terminals 23 make full sliding contact, but this frictional resistance may be no more than necessary to assure thorough electrical contact of the contacts and will not incline the manipulator of the parts to twist or cant the tube and socket because of any excessive resistance as has been experienced with prior structures. Therefore, liability of distortion of any of the bowed spring wiper contacts 23 during the assembly operation is virtually eliminated because due to the construction and relationship of the key 38 and the groove 39 the increased retention grip provided by their interengagement comes into play in about the last third of the relative assembly stroke. This leaves about two-third of the assembly stroke for relatively easy assembly movement. By the same token, to effect relative separation movement of the socket and tube, major separating force need be applied only in about the initial third of separating movement to release the additional retention grip of the compressed key 38 and while the parts are in a substantially stabilized condition and retained against any substantial relative canting. In the final two-third of the separating movement the resistance to separation is minimal and thus minimizes any tendency toward relative canting distortion and possible damage to the wiper contacts 23.

Figure 5:
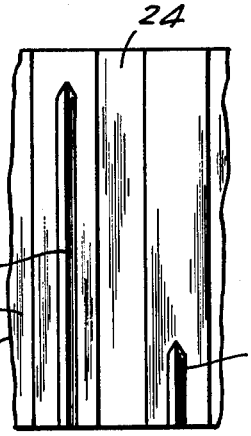
FIG. 5 is an enlarged fragmentary elevational detail view taken substantially in the plane of V—V of FIG. 4.
Figure 4:
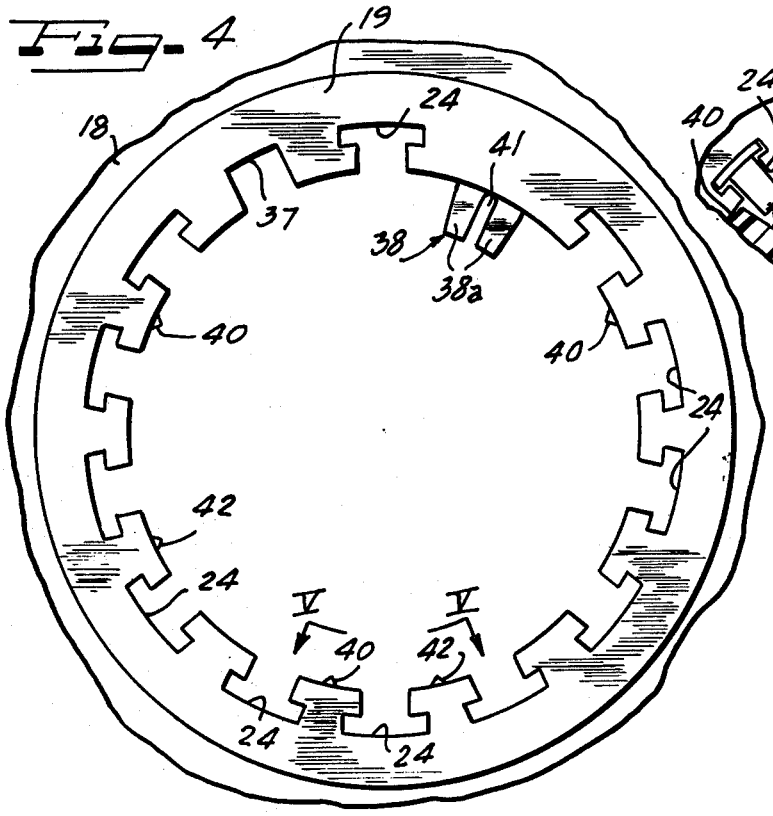
FIG. 4 is an enlarged top plan view of the tube mount boss of the tube socket and minus the usual electrical terminals.

In order to stabilize the slip fit push-on interengagement of the parts when the increased retention key 38 comes into play, means in the form of a pair of elongated longitudinally extending limited contact spacer and lateral thrust bearing ribs 42 (FIGS. 4 and 5) are provided within the tube base receiving bore 20 in symmetrical relation opposite the key 38 and equally spaced such as about 38° from a longitudinal plane through the center of the slot 41. The ribs 42 are on the lands which are separated at each side by one of the grooves 24 beyond the groove 24 which is directly opposite the key 38. For best results, the ribs 42 extend just short of the upper or entry end of the socket bore 20 entirely to the opposite end of the bore. Similarly to the shorter stabilizing ribs 40, the ribs 42 are perferably of generally triangular cross section with their apeces projecting inwardly and presenting substantially line contact surfaces for engagement with the perimeter of the tube base 17 along corresponding lands thereof between certain of the terminal grooves 22 thereof. Further, for best results the ribs 42 may be slightly shallower than the ribs 40. Where, for example, the ribs 40 are about 0.014 to 0.017 inch in depth, the ribs 42 may be about 0.008 inch in depth. Through this arrangement, after the tube base 17 has been oriented by means of the keys 35 and 38 and the respective keyways 37 and 39 at the beginning of the push-on assembly, initial limited pilot entry of the base 17 is quite free for at least about one-third of its insertion movement into the socket until it meets the inwardly bowed wiper contacts 23 which desirably normally project inwardly sufficiently to substantially bottom in the base terminal grooves 22 and then as assembly progresses engage in firm wiping contact with the pin-like contacts 21. As the assembly progresses to the last third of the relative push-on movement, and the increased retention compression of the split key 38 comes into play, any tendency for the tube base 17 to be displaced eccentrically away from the key 38 by radial component of force will be resisted by the spacer and lateral thrust bearing rib 42 in engagement with the tube base 17 generally opposite to the key 38. These ribs 42 cooperate with the key 38 in applying the increased retention grip on the tube base to completion of the push-on assembly whereupon the short symmetrically located stabilizing ribs 40 on engaging the base 17 assure ultimate concentricity of the base 17 within the socket 15 and thus substantially equal contact between all of the contacts 21 and 23.

FIGS. 8–10 depict new and improves increased retention means for a socket 43 of the general type disclosed in U.S. Pat. No. 3,818,278 and receptive of a stem-like tube base 44 having a single longitudinal key 45 receptive in a keyway 37 opening into a tube base receiving bore 48 in the socket. Terminal pins 49 projecting from a proximal end collar 50 on the base 44 are received in respective tube terminal pin-receiving socket holes 51 in a smaller diameter tube mount platform boss 52 concentrically on a larger diameter socket body 53. Within the boss 52 and socket body the tube terminal pins 49 are engaged in pin receptacles or sockets 54 in socket bores 55, and have tail terminals 57 adapted to engage with and be connected to printed circuitry of a printed circuit board similar to the board 32 depicted in FIG. 2. It will be appreciated, of course, that frictional engagement between the contact pins 49 and the pin sockets 54 of the terminals 55 will provide some frictional retention of the tube and socket in assembly.

More adequate, increased retention is provided by means of symmetrically arranged stiffly resilient gripping fingers 58 which are desirably molded integrally with the boss 52 to project above its tube base receiving crown face for engagement with the perimeter of the tube base collar 50 in assembly. In a preferred construction, the frictional retaining fingers 58 comprise a uniformly spaced circular array with narrow separating slots 59 therebetween. For utmost gripping value, the fingers 58 are of substantial width and of at least inside transversely accurate form conforming to a circle matching and of slightly undersize diameter relative to the substantially cylindrical perimeter of the tube base collar 50 so that when the tube base collar is pressed into the finger array a firm substantially press fit frictional grip of the fingers on the tube base collar perimeter will result. The relationship is such that the increased retention finger engagement of the collar 50 will occur in the final increment of push-on assembly. Initial contact between the base collar 50 and the fingers 58 is at lead-in chamfers 60 on the inner sides of the distal ends of the fingers. Then as the members are pushed together, the fingers 58 yield resiliently under tension as they uniformly expand slightly as the collar 58 is driven home therein. This is depicted in FIG. 10 wherein it will be noted that the fingers are slightly displaced from the normal dash line position to the full line position wherein the fingers 58 firmly uniformly grip the socket base collar and retain the tube and socket thoroughly against unintentional separation until forcefully pulled apart. In order to facilitate resilient bending displacement of the fingers 58, the notches 59 extend a short distance into the boss 52 as shown at 61, thus relieving strain on especially the proximal ends of the fingers 58 in the fully assembled relation of the tube base in the socket 43.

It will be understood that variations and modifications may be effected without departing from the spirit and scope of the novel concepts of this invention.

I claim as my invention:

1. A cathode ray tube socket, comprising:

a molded dielectric body carrying an array of electrical terminals for frictional push-on electrical engagement with complementary terminals on cathode ray tube base means;

increased retention means on said body separate from said array of terminals for axial push-on retaining engagement with the tube base means;

and said increased retention means comprise resiliently flexible frictional gripping structure molded integrally on one piece with said body and having rectilinear surfaces extending generally in the direction of the axis of the body for slidable engagement with rectilinear surface areas of the tube base means when the tube base means is pushed axially into assembly with the body for thoroughly retaining the tube base means against separation from fully assembled relation with the socket body until the socket and tube base means are deliberately pulled apart.

2. A tube socket according claim 1, wherein said increased retention means comprise a split key on the body engageable in frictional gripping compressed relation in a generally complementary keyway in the tube base means.

3. A tube socket according to claim 1, wherein said increased retention means comprise retaining fingers carried by the dielectric body and grippingly engageable with an annular axially rectilinear surface along the tube base means.

4. A tube socket according to claim 3, wherein the body has a smaller diameter tube mount platform boss, and said increased retention means fingers comprise projections from said boss.

5. A cathode ray tube socket according to claim 1, wherein said body has a bore aperture receptive of stem-like structure of the tube base means, and said increased retention means comprise a split compressible key shorter than said bore aperture, and engageable retainingly with the tube base structure in a final increment of push-on assembly of the socket and tube base means.

6. A tube socket according to claim 5, including longitudinal combination spacer and lateral thrust bearing rib means in said bore aperture opposite the increased retention key and cooperating with the key in maintaining increased retention engagement with the tube base means.

7. In an assembly of a cathode ray tube having a base member carrying an array of electrical terminals and a socket structure member carrying an array of complementary terminals, the tube base member and the socket member being adapted to be assembled by push-on relative assembly movement, and the electrical terminals of the tube base member and of the socket member entering into frictional electrical engagement and providing primary retention against unintentional separation of the base member and socket member, the improvement comprising:

increased retention means supplemental to the retention afforded by said terminals and including frictionally interengaging rectilinear surfaces on said members;

said rectilinear surfaces on one of said members comprising resiliently flexible gripping structure.

8. An assembly according to claim 7, wherein said socket member comprises a molded dielectric body having a socket receiving boss with a crown on which the base member is received, said increased retention means comprising an array of straight fingers projecting axially from the perimeter of said crown and engaging the base member, and means to facilitate resilient bending displacement of the fingers comprising notches between the fingers extending a short distance into the perimeter of the boss whereby to relieve strain on especially the proximal ends of the fingers in the fully assembled relation of the tube base member on the socket receiving boss within the array of fingers.

9. An assembly according to claim 7, wherein said increased retention means are resiliently yieldable and are placed under tension by interengagement with surface area of the other of the members.

10. An assembly according to claim 7, wherein said socket member comprises a dielectric body having a socket receiving boss with a crown on which the base member is received, and said increased retention means comprises an array of straight fingers projecting from said crown and engaging the base member.

11. An assembly to claim 7, wherein said increased retention means comprise a split compressible key on one of said members having friction surfaces, and a keyway in the other of said members receptive of the key and having friction surfaces placing the key under compression.

12. An assembly according to claim 11, wherein said key and keyway are interengageable in a terminal increment of push-on relative assembly of the members.

13. An assembly according to claim 11, wherein said socket member comprises a molded dielectric body having a bore aperture and the tube base member has a stem-like portion received in said tube aperture, said stem-like portion having the key groove and the body having the key integrally molded therewith.

14. An assembly according to claim 13, wherein said body has a plurality of spaced, longitudinally extending combination spacer and lateral thrust bearing ribs in said bore aperture located symmetrically opposite said key.

15. An assembly according to claim 7, wherein said increased retention means comprise fingers on one of said members and having rectilinear surfaces interengageable frictionally with rectilinear surface area of the other of said members.

16. An assembly according to claim 15, wherein said fingers are molded integrally and straight surfaced with a dielectric body of said socket member, and said base member has an annular axially rectilinear surface engaged by the finger surfaces.

17. A cathode ray tube socket, comprising:

a dielectric body carrying an array of electrical terminals for frictional push-on electrical engagement with complementary terminals on cathode ray tube base means;

increased retention means on said body separate from said array of terminals for axial push-on retaining engagement with the tube base means;

and said increased retention means comprising a split key on the body engageable in frictional gripping compressed relation in a generally complementary keyway in the tube base means.

18. A cathode ray tube socket, comprising:

a dielectric body carrying an array of electrical terminals for frictional push-on electrical engagement with complementary terminals on cathode ray tube base means;

and increased retention means on said body separate from said array of terminals for push-on retaining engagement with the tube base means;

said body having a bore aperture receptive of stem-like structure of the tube base means, and said increased retention means comprising a split compressible key shorter than said bore aperture and engageable retainingly with the tube base structure in a final increment of push-on assembly of the socket and tube base means.

19. A tube socket according to claim 18, including longitudinal combination spacer and lateral thrust bearing rib means in said bore aperture opposite the increased retention key and cooperating with the key in maintaining increased retention engagement with the tube base means.

20. In an assembly of a cathode ray tube having a base member carrying an array of electrical terminals and a socket structure member carrying an array of complementary terminals, the tube base member and the socket member being adapted to be assembled by push-on relative assembly movement, and the electrical terminals of the tube base member and of the socket member entering into frictional electrical engagement and providing primary retention against unintentional separation of the base member and socket member, the improvement comprising:

increased retention means supplemental to the retention afforded by said terminals and including frictionally interengaging surfaces on said members;

said increased retention means comprising a split compressible key on one of said members having friction surfaces;

and a keyway in the other of said members receptive of the key and having friction surfaces placing the key under compression.

* * * * *